US009822552B2

(12) United States Patent
Eller et al.

(10) Patent No.: US 9,822,552 B2
(45) Date of Patent: Nov. 21, 2017

(54) ELECTRIC LATCH RETRACTION DEVICE FOR VERTICAL ROD DOOR LATCHES

(71) Applicant: Sargent Manufacturing Company, New Haven, CT (US)

(72) Inventors: Darren C. Eller, East Lyme, CT (US); Christopher C. Hill, New Britain, CT (US); Andrew Geraci, Branford, CT (US)

(73) Assignee: SARGENT MANUFACTURING COMPANY, New Haven, CT (US)

( * ) Notice: Subject to any disclaimer, the term of this patent is extended or adjusted under 35 U.S.C. 154(b) by 91 days.

(21) Appl. No.: 14/648,007

(22) PCT Filed: Dec. 12, 2013

(86) PCT No.: PCT/US2013/074593
§ 371 (c)(1),
(2) Date: May 28, 2015

(87) PCT Pub. No.: WO2014/093586
PCT Pub. Date: Jun. 19, 2014

(65) Prior Publication Data

US 2015/0308155 A1 Oct. 29, 2015

Related U.S. Application Data

(60) Provisional application No. 61/737,475, filed on Dec. 14, 2012.

(51) Int. Cl.
*E05C 1/06* (2006.01)
*E05B 47/00* (2006.01)
(Continued)

(52) U.S. Cl.
CPC ..... *E05B 47/0012* (2013.01); *E05B 47/026* (2013.01); *E05B 65/108* (2013.01);
(Continued)

(58) Field of Classification Search
CPC .. E05B 47/0012; E05B 47/026; E05B 65/108; E05B 2047/0067; E05B 63/20;
(Continued)

(56) References Cited

U.S. PATENT DOCUMENTS 4,565,994 A * 1/1986 Mochida ..... E05B 45/06 200/61.64
5,684,457 A * 11/1997 Miller ..... E05B 37/00 307/119
(Continued)

FOREIGN PATENT DOCUMENTS

DE 4401971 A1 8/1995
EP 1283318 A1 2/2003

OTHER PUBLICATIONS

International Search Report for corresponding PCT Application No. PCT/US2013/074593 dated Dec. 26, 2013.
(Continued)

*Primary Examiner* — Carlos Lugo
*Assistant Examiner* — Faria Ahmad
(74) *Attorney, Agent, or Firm* — DeLio, Peterson & Curcio, LLC; Kelly M. Nowak

(57) ABSTRACT

An electric latch retraction device for vertical rod door latches includes an automatic adjustment feature including a limit switch and a linear sensor, such as a Hall effect sensor, which detects vertical position. A microcontroller monitors the vertical position of a pivoting retraction lever driven at the pivot by a linear driver. The housing for the electric latch retraction device is preferably external to the door and one end of the retraction lever extends into the door to drive a vertical rod door latch mechanism while an opposed end contacts the limit switch to signal that continued driving of the linear driver will begin to drive the vertical rod door latch. The microcontroller determines from the vertical position of the retraction lever when the limit switch is
(Continued)

actuated whether the electric latch retraction device is mounted too high or too low.

20 Claims, 5 Drawing Sheets

(51) Int. Cl.

| | |
|---|---|
| ***E05B 65/10*** | (2006.01) |
| ***E05C 1/08*** | (2006.01) |
| ***E05B 47/02*** | (2006.01) |
| ***E05C 9/04*** | (2006.01) |
| *E05C 1/00* | (2006.01) |
| *E05C 1/12* | (2006.01) |
| *E05C 9/00* | (2006.01) |
| *E05C 9/10* | (2006.01) |
| *E05B 63/20* | (2006.01) |

(52) U.S. Cl.
CPC ..... *E05C 1/08* (2013.01); *E05C 9/04* (2013.01); *E05B 63/20* (2013.01); *E05B 2047/0023* (2013.01); *E05B 2047/0067* (2013.01); *E05B 2047/0091* (2013.01); *E05B 2047/0094* (2013.01)

(58) Field of Classification Search
CPC ..... E05B 2047/0023; E05B 2047/0091; E05B 2047/0094; E05C 1/08; E05C 9/04

USPC ..... 292/32, 33, 92–94, 144; 70/277, 278.7, 70/279.1, 280–282, 461
See application file for complete search history.

(56) References Cited

U.S. PATENT DOCUMENTS

| | | | | |
|---|---|---|---|---|
| 6,259,352 | B1 * | 7/2001 | Yulkowski | E05B 47/00 340/5.7 |
| 6,598,439 | B1 * | 7/2003 | Chen | E05B 17/14 70/416 |
| 7,748,757 | B2 * | 7/2010 | Shen | E05B 65/1006 292/92 |
| 8,830,066 | B2 * | 9/2014 | Chen | G06K 19/07745 206/119 |
| 2003/0024288 | A1 | 2/2003 | Gokcebay et al. | |
| 2004/0011347 | A1 | 1/2004 | Ramsey et al. | |
| 2006/0097573 | A1 * | 5/2006 | Gidge | H04B 3/58 307/3 |
| 2006/0220845 | A1 * | 10/2006 | Agrawal | G07F 9/026 340/545.1 |
| 2008/0012350 | A1 | 1/2008 | Condo et al. | |
| 2008/0204202 | A1 * | 8/2008 | Fislage | B60R 21/01 340/425.5 |
| 2011/0047874 | A1 | 3/2011 | Lowder et al. | |
| 2011/0234656 | A1 * | 9/2011 | Mizutani | G06Q 10/08 347/6 |
| 2012/0169071 | A1 | 7/2012 | Labarre | |
| 2012/0274456 | A1 * | 11/2012 | Patenaude | B60R 25/403 340/425.5 |
| 2013/0181825 | A1 * | 7/2013 | Johnson | B60Q 9/00 340/440 |
| 2014/0097959 | A1 * | 4/2014 | Hosey | B60R 16/023 340/652 |
| 2014/0292001 | A1 * | 10/2014 | Nunez | E05C 1/004 292/164 |
| 2015/0178767 | A1 * | 6/2015 | Wu | G06Q 30/0241 340/5.91 |
| 2015/0248569 | A1 * | 9/2015 | Rushing | G01C 15/04 340/10.34 |

OTHER PUBLICATIONS

International Written Opinion for corresponding PCT Application No. PCT/US2013/074593 dated Apr. 3, 2014.

* cited by examiner

Full Assembly (Door omitted for clarity)

ELECTRIC LATCH RETRACTION DEVICE FOR VERTICAL ROD DOOR LATCHES

PRIORITY

This application claims priority to International Application No. PCT/US2013/074593 filed Dec. 12, 2013, which claims priority to U.S. Provisional Application No. 61/737,475 filed Dec. 14, 2012.

FIELD OF THE INVENTION

This invention relates to electric latch retraction devices that operate vertical rod door latches. More specifically, it relates to an electric latch retraction device that drives a vertical rod door latch to latch and unlatch a door and which cooperates with a mechanical latch actuator, such as a lever handle door trim or exit device, connected to mechanically drive the same vertical rod door latch mechanism.

DESCRIPTION OF RELATED ART

Vertical rod door latches are door latches commonly used in commercial or public buildings where the door latches are located at the top and/or bottom edge of the door. Vertical rod door latches typically include one or more latches or catches that extend upward out of the top and/or downward from the bottom edge of the door into a corresponding opening in a strike located in the door frame above the door or on the floor below the door.

The latches are most commonly driven into and out of engagement with the corresponding strike by vertical rods extending from an actuator located near the midpoint of the door to the top and/or bottom latches. The vertical rods extending from the actuator may be hidden inside the door or located on the surface of the door and they may drive the latches at each point with either a pulling or pushing motion.

Although stiff vertical rods capable of applying a push or pull force to the latch points are the most common method of driving the latches, for the purpose of this application, the term "vertical rod door latch" is not intended to be limited to designs using only stiff vertical rods. The term is intended to include other mechanical drive mechanisms for driving the top and bottom latch points, such as cable drive systems and any other method by which an actuator mounted on the door can apply force to mechanically drive latch points at the top and/or bottom edges of the door.

The actuator most commonly used to drive the latch points of a vertical rod door latch is a pushbar or pushrail type exit device. An "exit device" is a lock mechanism operated from the inside of an exit door through the use of a crossbar, pushbar, pushrail, panic bar or paddle actuator that moves towards the exit door to retract the latches when pressure is applied.

The pushbar is typically spring biased away from the exit door. When horizontal pressure is applied, the pushbar moves horizontally in towards the mounting rail, compresses the biasing springs and retracts the latch rods at the top and/or bottom to unlatch the exit door. Exit devices of this general type may be seen in U.S. Pat. Nos. 4,384,738; 5,531,492 and U.S. Design Pat. No. 279,647 all of which are assigned to Sargent Manufacturing Company, the assignee of the present patent application.

Conventional exit devices have sufficient room inside the housing for the exit device to allow motorized drive units to be mounted therein. The motorized drive can emulate the pushing motion needed to retract the latch rods either by driving the pushbar directly or by driving the vertical rods through other linkages in the exit device. Such motorized drives allow the vertical rod exit device to be operated in response to an electrical signal. U.S. Pat. No. 7,883,123, which is assigned to Sargent Manufacturing Company, the assignee of the present patent application, shows such an exit device drive system intended for mounting within the housing of a pushbar operated exit device.

Electrical control to retract the latches is desirable when the door is to be latched and unlatched by an access control system, which may incorporate a card reader, keypad, proximity detector, fingerprint or other biometric identification system, etc. that is mounted adjacent to or on the door to provide access control. Other applications for electrical latch retraction include fire control systems for a building that operate door latches remotely or for pushbutton controls mounted adjacent to the door for access by the disabled.

Although it is known to provide electric latch retraction of a vertical rod door latch by adding a motorized drive within a pushbar type exit device housing, there is a need for electric latch retraction when the vertical rod door latch is to be driven by a lever handle trim or a mechanical drive not designed with an integrated electrical drive system. The housing of most lever handle trim units does not provide sufficient room for a motor drive system to be installed, such as the drive system seen in U.S. Pat. No. 7,883,123. There is a need for an electric latch retraction device that has a separate housing and is mounted independently from the mechanical drive for the vertical rod latch.

There is also a need for an electric latch retraction system that can be added to an existing mechanical, non-electrified, vertical rod design. Such a design could be used regardless of whether the vertical rod door latch is mechanically driven by an exit device, a lever handle trim or any other type of handle or trim capable of driving the vertical rod latch. It would be desirable to be able to supply such an independent electric latch retraction design at the time of purchase with an existing mechanical actuator, such as an exit device or handle trim, or to be able to install the electric latch retraction device later in the field, where it is to be connected as a retrofit to drive a previously installed mechanically operated vertical rod door latch.

A problem with any separately installed electric latch retraction device is that it must be adjusted for proper operation. It would be desirable for the electric latch retraction device to automatically adjust to compensate for variations in the position of the installed electric latch retraction device or the relative position of the installed vertical rod door latch.

It would also be desirable to be able to eliminate the need for functional lever trim on the door. By mounting an electric latch retraction device in a separate housing and providing electrical control to operate the vertical rod door latch, the trim at the midpoint of the door does not need to mechanically operate or connect to the vertical rod door latch and does not need to perform any door latching or locking functions.

SUMMARY OF INVENTION

The present invention is directed to an electric latch retraction device for driving a vertical rod door latch that includes a pivoting retraction lever having an end adapted to drive the vertical rod door latch, a limit switch mounted to detect a position of the retraction lever at a pivoting limit of motion thereof and provide a limit signal indicative thereof, a linear sensor providing a vertical position signal corresponding to a vertical position of the pivoting retraction lever, a linear driver mounted to vertically drive the pivoting retraction lever and a control circuit connected to drive the linear driver in vertical motion and connected to receive the limit signal and the vertical position signal, the control circuit driving the pivoting retraction lever in vertical motion and determining the vertical position of the pivoting retraction lever when the limit signal is actuated to detect installation position errors of the electric latch retraction device relative to the vertical rod door latch.

In one aspect of the invention, the linear sensor is a Hall effect sensor.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 4A shows the door and the position of FIG. 4B, which is encircled. FIG. 4B shows the encircled portion of FIG. 4A at an increased scale.

FIG. 5A shows the door and the position of FIG. 5B, which is encircled. FIG. 5B shows the encircled portion of FIG. 5A at an increased scale.

FIG. 6A shows the door and the position of FIG. 6B, which is encircled. FIG. 6B shows the encircled portion of FIG. 6A at an increased scale.

FIG. 6A shows the door and the position of FIG. 6B, which is encircled. FIG. 6B shows the encircled portion of FIG. 6A at an increased scale.

DESCRIPTION OF THE PREFERRED EMBODIMENT(S)

In describing the preferred embodiment of the present invention, reference will be made herein to FIGS. 1-7B of the drawings in which like numerals refer to like features of the invention.

Figure 1:
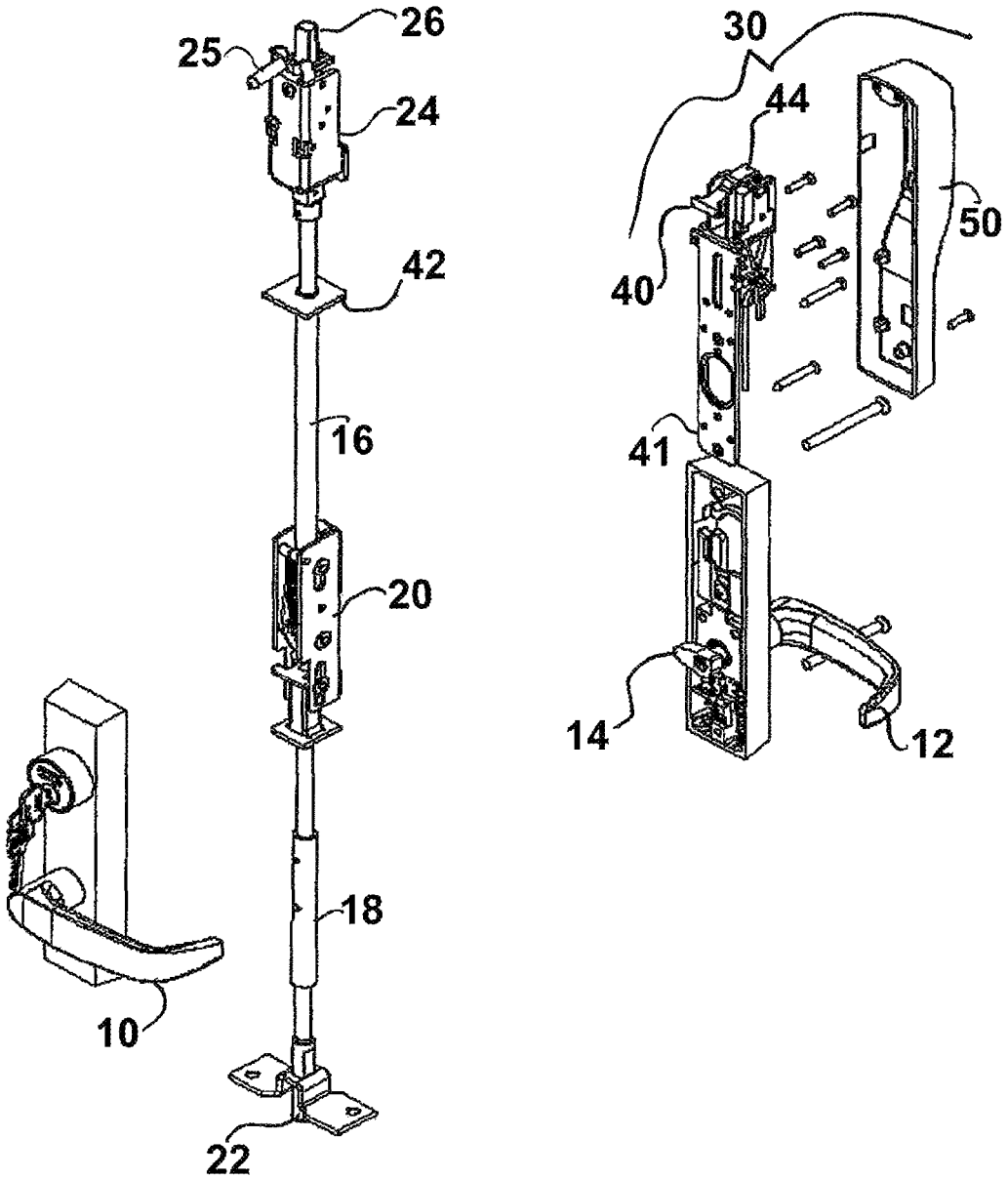
FIG. 1 is a perspective partially exploded view of an electric latch retraction device according to the present invention in combination with a vertical rod door latch operated by lever handles. The door on which the components are to be mounted is omitted for clarity.

Referring to FIG. 1, an exterior lever handle 10 and an interior lever handle 12 are connected together to drive a cam 14 when either handle is turned. Cam 14 drives a vertical rod door latch having an upper vertical rod 16 and lower vertical rod 18. Although the embodiment of the invention disclosed herein is shown as driving a vertical rod door latch system with rigid vertical rods, the electric latch retraction device of the present invention can also drive other types of multipoint latch systems, such as cable driven latch systems and the like.

The vertical rods 16, 18 are mechanically linked in a conventional manner to move together, but in opposite directions through vertical rod connection assembly 20. When the upper vertical rod 16 moves down, the lower vertical rod 18 moves up. The lower vertical rod 18 drives a lower latch having a pin 22 that enters a corresponding strike or opening typically mounted in the floor. The upper latch is provided with a latch assembly 24 and an upper pin 26 that also enters a corresponding strike or opening in the door frame at the top.

In the vertical rod door latch illustrated, the upper latch assembly 24 acts to hold the pins 22 and 26 in the retracted position when the door is open and to release them when the door is closed using sensing pin 25. The vertical rods 16, 18 are preferably located inside the door so that they are hidden. By rotating handles 10 or 12 the vertical rods can be moved to unlatch the upper and lower latches by retract the upper and lower pins 26, 22 from their respective strike openings. This unlatches the door from the door frame and floor and allows the door to open.

Those familiar with this art will recognize that the vertical rod system described so far is substantially conventional and is known in the art. The vertical rod assembly from the upper latch and pin 26 through the connection assembly 20 to the lower latch and pin 22 may be operated from the connection assembly 20 by any of several known types of exit devices or lever handles. It is also possible to omit the lower vertical rod 18 and the lower pin 22 or to add a midpoint latch with a pushbar exit device.

However, using conventional components, it is not possible to add electric latch retraction except by adding an electrically operated exit device to replace the interior lever handle 12. There is insufficient space within the lever handle trim housing to accommodate electric latch retraction. Moreover, lever handles may be preferred in many situations, or it may be preferred to use pulls instead of rotating handles.

The present invention accommodates these needs, which cannot be met with conventional latches, and allows retrofitting, by providing a separately mounted independently housed and independently driven electric latch retraction device 30. The electric latch retraction device 30 cooperates with and does not interfere with the mechanical latch retraction components described above.

The electric latch retraction device 30 is a motorized drive unit that in one aspect uses a linear actuator capable of driving the vertical rods under remote control. Specifically, electronic latch retraction device 30 is mounted on the exterior of the door, typically at a point above the connection assembly 20. The electric latch retraction device 30 includes a pivoting retraction lever 38 having a right end 40 and a left end 44. The right end 40 drives the upper rod 16 down by contacting a metal plate 42 attached to the vertical rod 16. As the upper rod 16 moves down, the lower rod moves up due to the linkage and interconnection therebetween at the connection assembly 20.

Figure 2A:
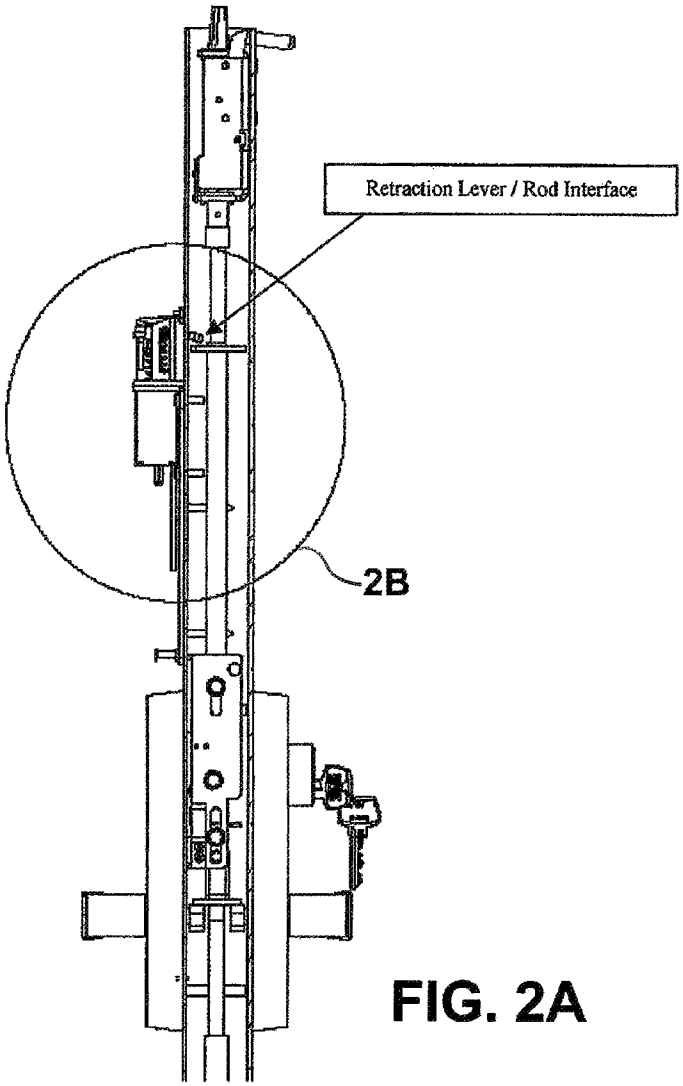
FIG. 2A is a right side elevational view of the invention in FIG. 1 looking towards the edge of the door on which the components are mounted. The door is shown and the electric latch retraction device of the present invention is shown encircled and marked 2B. The cover of the electric latch retraction device has been omitted to better show the components within.
Figure 2B:
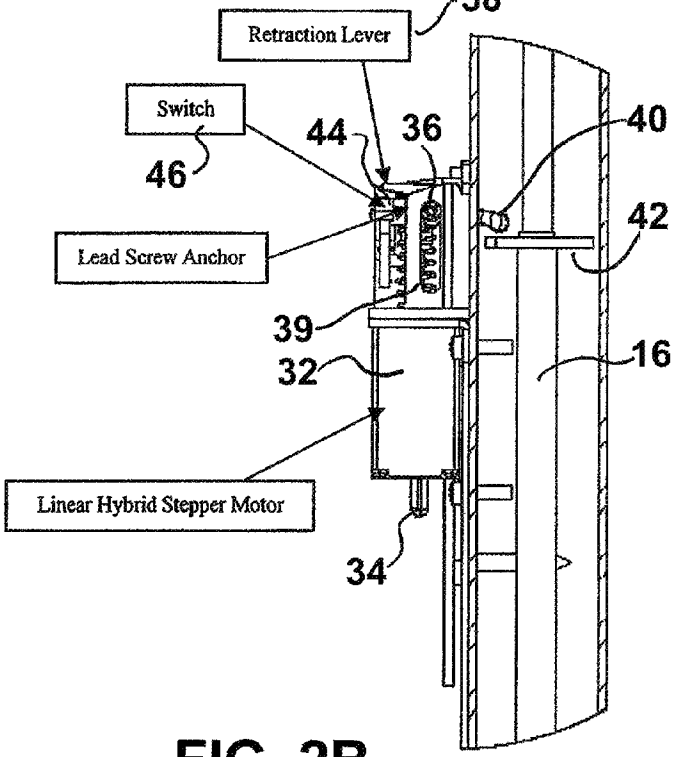
FIG. 2B shows the encircled portion of FIG. 2A at an increased scale to better illustrate the electric latch retraction device according to the present invention. Again, the cover of the electric latch retraction device has been omitted to better show the components located within.

Referring to the remaining drawings, and particularly FIG. 2B, it will be seen that in one aspect of the invention, drive unit 32 is a linear actuator formed by a linear hybrid stepper motor 32 that drives a threaded lead screw 34. The stepper motor in the linear actuator 32 turns a nut threaded onto the threaded lead screw 34. As the stepper motor turns the nut, the lead screw 34 moves vertically up and down. Due to the stepping action and thread pitch, this vertical motion can be accurately controlled.

Figure 3:
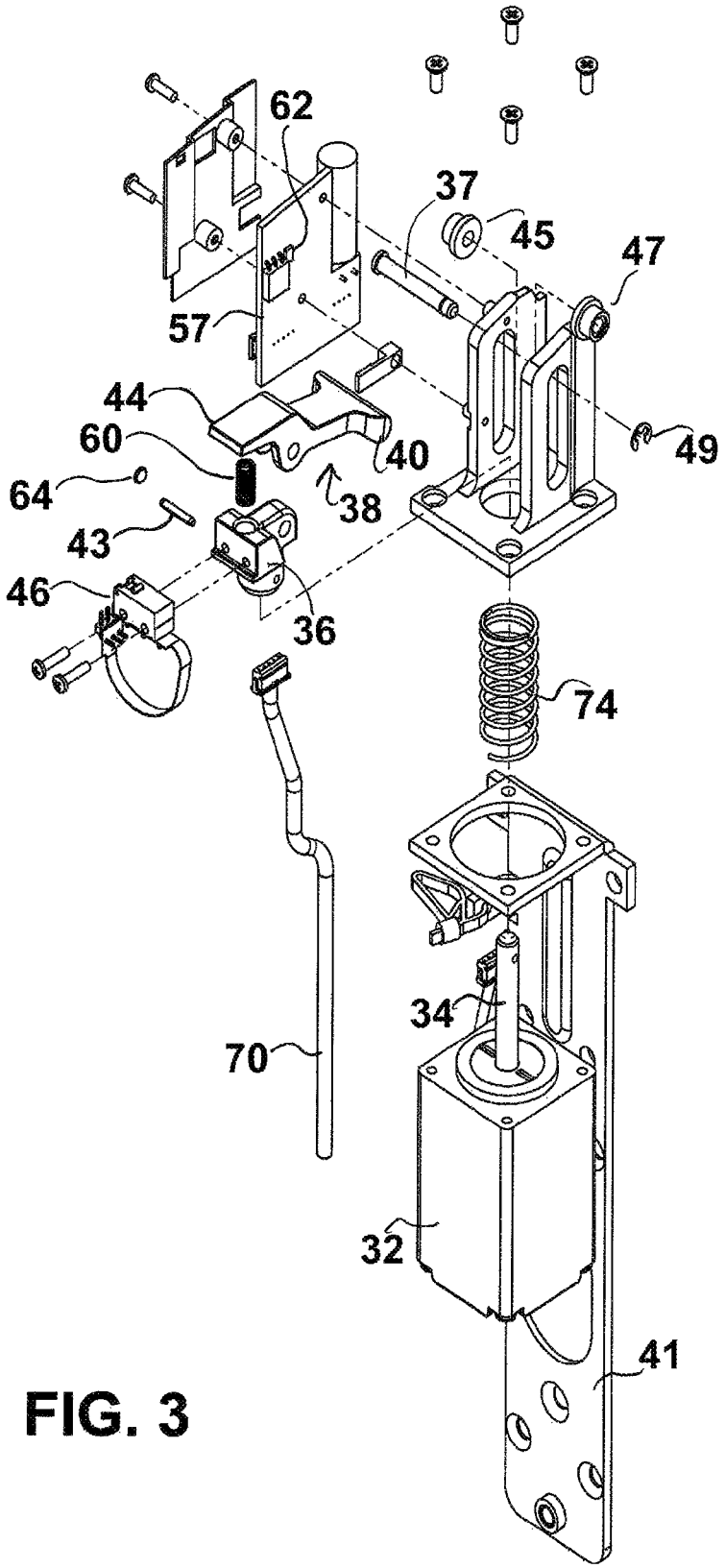
FIG. 3 shows an exploded perspective view of the electric latch retraction device according to the present invention
Figure 4A:
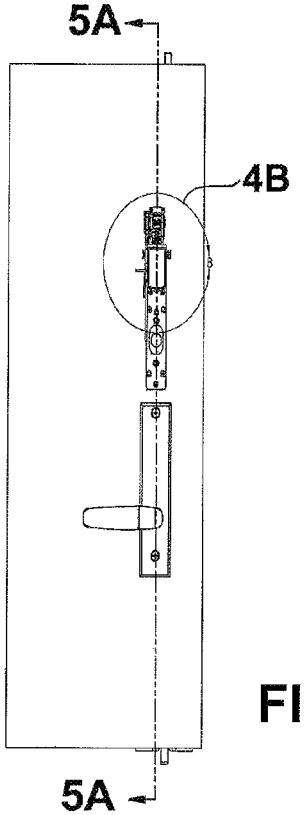
FIGS. 4A and 4B are front elevational views showing the invention mounted on a door as in FIGS. 2A and 2B. The cover of the electric latch retraction device has been omitted from both views to better show the components located within.
Figure 5A:
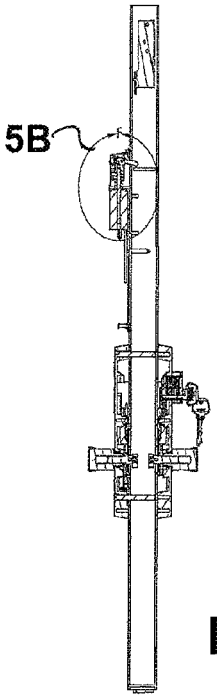
FIGS. 5A and 5B are cross sectional views showing the invention mounted on a door as in FIGS. 2A and 2B looking from the right side of the invention. The cross section is taken through the central axis of the linear actuator along the line 5A-5A in FIG. 4A. The cover of the electric latch retraction device has been omitted to better show the components located within.
Figure 4B:
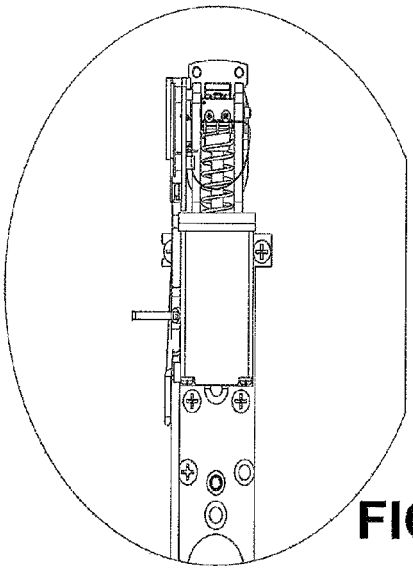
Figure 5B:
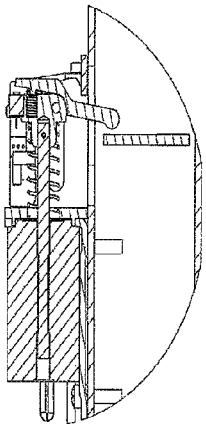
Figure 6A:
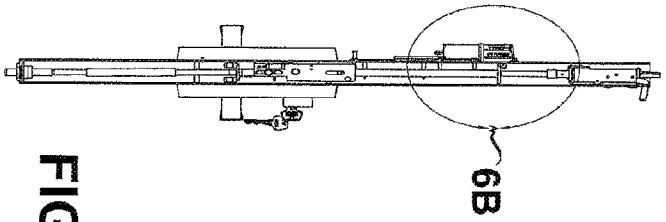
FIGS. 6A and 6B are right side elevational views showing the invention mounted on a door as in FIGS. 2A and 2B. The cover of the electric latch retraction device has been omitted from both views to better show the components located within.
Figure 7A:
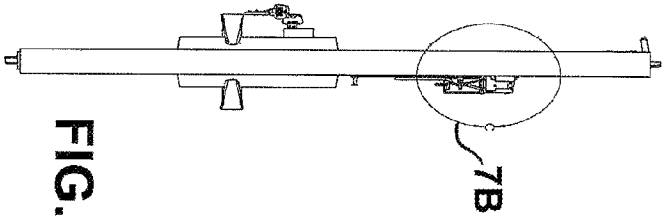
FIGS. 7A and 7B are left side elevational views showing the invention mounted on a door as in FIGS. 2A and 2B. The cover of the electric latch retraction device has been omitted from both views to better show the components located within.
Figure 6B:
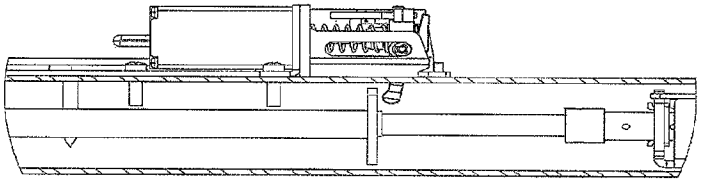
Figure 7B:
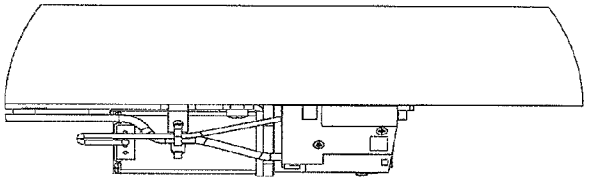

Referring to FIG. 3, at the top end of the lead screw 34 is a lead screw anchor 36, preferably made of steel that is pinned to the end of the lead screw 34 with pin 43. The lead screw anchor 36 includes a shaft 37 having a horizontal axis. The shaft 37 is carried in a pair of bushings 45, 47 that slide vertically in slot 39. The shaft 37 is held in place with a C-clip 49. Retraction lever 38 tilts or pivots through a limited range.

The retraction lever 38 extends from the exterior of the door thorough an opening in the surface of the door and into the interior of the door where the right side 40 of the retraction lever is in position to contact metal plate 42 attached to the vertical rod 16. A spring 60 (see FIG. 3) pushes up on the left side 44 of the retraction lever 38 to ensure that the right side 40 contacts the metal plate 42.

When downward force is applied to the metal plate 42, the upper pin 26 is refracted downward and the lower pin 22 is retracted upward. This downward force on the plate 42 is applied by the stepper motor 32 and more specifically by the shaft 34 which pulls down on the lead screw anchor 36, which then pulls down on the retraction lever 38.

As the shaft forming the lead screw anchor 36 moves down, the retraction lever 38 initially tilts or pivots as it rotates around the shaft 37 in the lead screw anchor 36. During this initial pivoting action the vertical rods do not move. Instead, the left side 44 of the retraction lever 38 initially moves down a short distance until it reaches a limit. Limit switch 46 is mounted to the lead screw anchor and is located at the limit of travel of the pivoting retraction lever. As the left side 44 of the retraction lever reaches the limit, it contacts and actuates limit switch 46 to sense when the left side 44 has reached the predefined limit.

The limit switch 46 is connected via a flexible ribbon connection 72 to a control circuit 51 in the form of a microcontroller mounted on a circuit board. Microcontroller circuit board 51 includes a microcontroller, a Hall effect sensor, and a power system, as well as connectors for connecting to the limit switch, an external control system, and the linear actuator.

Prior to the point where the left side 44 of the retraction lever 38 contacts limit switch 46, motion of the lead screw anchor 36 and the retraction lever 38 causes the left side 44 of the retraction lever 38 to move down and the right side 40 of the retraction lever 38 to remain stationary in contact with plate 42. Spring 60 is compressed during this initial motion as the retraction lever pivots counterclockwise about the lead screw anchor 36. The upward force applied by spring 60 on the left side 44 of the refraction lever is insufficient to force the right side 40 down or to operate the vertical rods of the vertical rod door latch system.

However, after the left side 44 of the retraction lever 38 contacts limit switch 46, the left side 44 is unable to move any further down and the right side 40 begins to move down. As the stepper motor drive continues, the lead screw anchor 36 and the retraction lever 38 continue to move down. The lead screw anchor 36 and the shaft 37 move down in slot 39. The retraction lever 38 rotates clockwise about the shaft 37. This drives the plate 42 and the upper vertical rod 16 down to unlatch the vertical rods. In the illustrated vertical rod system, once the vertical rod 16 has moved down ½" the top and bottom latches are known to be fully retracted.

It will be understood that the housing 50 and the baseplate 41 are mounted to the surface of the door with the screws, as shown in FIG. 1. Because the electric latch retraction device 30 is independently housed and separately mounted, its vertical location may vary relative to the location of the plate 42. Moreover, the lead screw anchor can only move a limited distance relative to slot 39. Accordingly, there is a limit to how far the electric latch retraction device 30 may be installed vertically up or down relative to the plate 42.

If the electric latch retraction device 30 is installed very high relative to plate 42, the lead screw anchor will have to move so far down before the left side of the refraction lever reaches its limit that there is no remaining travel to operate the vertical rods the required ½". Similarly, if the electric latch retraction device 30 is installed very low relative to plate 42, the left side of the retraction lever will already be pushed down into contact with its lower limit and downward force may already be applied to plate 42. If the installation of the electric latch retraction device 30 is so low that the plate 42 is already partially driven down, the electric latch retraction device will be unable to move upwards to fully release the vertical rods to operate normally. They will always be in a partially actuated condition.

To address this problem, the electric latch retraction device is provided with an auto adjustment feature. The auto adjustment feature relies partially upon the limit switch 46 and partially upon a Hall effect sensor 62 that monitors the position of the lead screw anchor 36 by detecting the vertical position of magnet 64 mounted to the lead screw anchor 36.

The operation of the device may be described as follows. Initially, the electronic latch retraction device is in the position shown in FIGS. 1, 2A and 2B. The lead screw anchor shaft 37 is at the top of the slot 39. Circuit board 51 is provided with a microcontroller which initially drives the stepper motor 32 to drive threaded shaft 34 down. The lead screw anchor 36 also moves down and the retraction lever 38 pivots about moving shaft 37 in a counterclockwise direction until the left end 44 of the retraction lever contacts switch 46. At this point the counterclockwise rotation of the retraction lever stops and continued motion of the shaft 34 down pulls down on the plate 42 to retract the vertical rods and unlatch the vertical rod door latch.

When the system is first installed, it must be installed such that the tilting or pivoting motion of the retraction lever 38 has the left end 44 disengaged from the limit switch 46 so that it is possible for the shaft 34 to move down under microprocessor control before switch 46 is contacted and before plate 42 begins to move down.

If the electric latch retraction device 30 is inadvertently installed too low on the door such that the switch 46 is already engaged by end 44 of the retraction lever 38, the microcontroller will detect this. The microcontroller is programmed at initial startup to detect this incorrect installation as described above where the limit switch 46 is already actuated.

On the other hand, if the electric latch retraction device 30 is inadvertently installed too high on the door it is possible that there will not be the required ½" of travel required after the switch has fired. To detect this type of installation error, the Hall effect sensor 62 signals the microcontroller of the circuit board 51 so that the vertical position of magnet 64 on the lead screw anchor 36 can be monitored. The electric latch retraction device must be able to drive the plate 42 downward at least one half inch after the limit switch 46 has been actuated. The microcontroller can detect the vertical position of the lead screw anchor 36 at the point when switch 46 is actuated and will know from that detection if one half inch of additional travel is available in slot 39. This is referred to as the auto adjustment feature of the present invention.

If ½" (approximately 12.5 mm) of additional travel is not remaining, there is an installation error that must be corrected before proper operation can be assured.

The electronic latch retraction device 30 is provided with a separate escutcheon or cover 50. A wire 70 is provided for connection to the control system, which signals when the vertical rod latch system is to be actuated. The microcontroller circuit board 51 is preferably fixed relative to the door while the limit switch 46, which is connected to the microcontroller circuit board 51, moves with the lead screw anchor 36.

Spring 74 acts to drive the lead screw anchor 36 and lead screw 34 upwards to the upper limit when power is removed from the device so that it starts in the position seen in FIG. 2B.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An electric latch retraction device for driving a vertical rod door latch comprising:

a pivoting retraction lever having an end adapted to drive the vertical rod door latch;

a limit switch mounted to detect a position of the retraction lever at a pivoting limit of motion thereof and provide a limit signal indicative thereof;

a linear sensor providing a vertical position signal corresponding to a vertical position of the pivoting retraction lever;

a linear driver mounted to vertically drive the pivoting retraction lever;

a control circuit connected to drive the linear driver in vertical motion and connected to receive the limit signal and the vertical position signal, the control circuit driving the pivoting retraction lever in vertical motion and detecting installation position errors of the electric latch retraction device relative to the vertical rod door latch from the limit signal and the vertical position signal by determining whether the electric latch retraction device has been installed in a position that prevents sufficient range of motion of the retraction lever when driven by the linear driver to properly operate the vertical rod door latch, such installation position error being identified by the control circuit driving the linear driver until the limit signal is received and determining from the vertical position signal that sufficient additional travel is available for the linear driver to drive the retraction lever and correctly operate the vertical rod door latch.

2. The electric latch retraction device for driving a vertical rod door latch according to claim 1 wherein the linear sensor is a Hall effect sensor.

3. The electric latch retraction device for driving a vertical rod door latch according to claim 1 wherein the vertical rod door latch includes a vertical rod and a plate attached to the vertical rod and wherein the end of the pivoting retraction lever adapted to drive the vertical rod door latch contacts the plate when driving the vertical rod door latch.

4. The electric latch retraction device for driving a vertical rod door latch according to claim 1 wherein:

the electric latch retraction device further includes a retraction lever shaft having a horizontal axis and the retraction lever pivots about the retraction lever shaft so that the end adapted to drive the vertical rod door latch moves vertically up and down relative to the retraction lever shaft as the retraction lever pivots;

the linear driver is connected to vertically move the shaft and the retraction lever together; and the retraction lever is at the pivoting limit of motion thereof when the linear driver drives the retraction lever and shaft to drive the vertical rod door latch.

5. The electric latch retraction device for driving a vertical rod door latch according to claim 4 further including an anchor driven by the vertical driver and wherein the retraction lever and retraction lever shaft are mounted on the anchor.

6. The electric latch retraction device for driving a vertical rod door latch according to claim 5 wherein the linear sensor is a Hall effect sensor and the anchor includes a magnet mounted thereon, the position of the magnet being detected by the Hall effect sensor to provide the vertical position signal corresponding to the vertical position of the pivoting retraction lever.

7. The electric latch retraction device for driving a vertical rod door latch according to claim 4 wherein the retraction lever shaft slides vertically within a slot.

8. The electric latch retraction device for driving a vertical rod door latch according to claim 4 wherein:

the retraction lever further includes a second end opposite the end adapted to drive the vertical rod door latch; and the second end of the retraction lever moves down as the end adapted to drive the vertical rod door latch moves up.

9. The electric latch retraction device for driving a vertical rod door latch according to claim 1 wherein the control circuit operates to detect an installation position error of the electric latch retraction device relative to the vertical rod door latch by determining whether the electric latch retraction device has been installed with the retraction lever at its pivoting limit of motion thereof, such installation position error being identified by the control circuit detecting that the limit signal is received prior to the control circuit driving the retraction lever in vertical motion.

10. The electric latch retraction device for driving a vertical rod door latch according to claim 1 wherein the control circuit determines from the vertical position signal that sufficient additional travel is available after the limit signal is received by driving the linear driver and moving the retraction lever the sufficient additional travel distance.

11. The electric latch retraction device for driving a vertical rod door latch according to claim 1 wherein the control circuit determines from the vertical position signal that sufficient additional travel is available after the limit signal is received by determining the position of the retraction lever from the vertical position signal when the limit signal is received and determining that the sufficient additional travel distance is, or is not, available from vertical position signals received at corresponding limits of travel of the retraction lever.

12. The electric latch retraction device for driving a vertical rod door latch according to claim 1 further including a retraction lever spring connected to bias the retraction lever away from the position corresponding to the pivoting limit of motion of the pivoting retraction lever.

13. The electric latch retraction device for driving a vertical rod door latch according to claim 12 wherein:

the retraction lever spring has insufficient spring force to operate the vertical rod door latch; and the control circuit drives the linear driver to pivot the retraction lever against the biasing force of the retraction lever spring and move the retraction lever to its pivoting limit of motion.

14. The electric latch retraction device for driving a vertical rod door latch according to claim 1 wherein the linear driver includes a linear hybrid stepper motor driving a threaded lead screw.

15. The electric latch retraction device for driving a vertical rod door latch according to claim 1 wherein the control circuit includes a microcontroller mounted on a circuit board and the linear sensor is a Hall effect sensor mounted on the circuit board.

16. The electric latch retraction device for driving a vertical rod door latch according to claim 15 further including power circuitry mounted on the circuit board.

17. The electric latch retraction device for driving a vertical rod door latch according to claim 1 further including a baseplate for the electric latch retraction device and a housing for the electric latch retraction device, the end of the pivoting retraction lever adapted to drive the vertical rod door latch extending outward from the baseplate to engage the vertical rod door latch.

18. The electric latch retraction device for driving a vertical rod door latch according to claim 17 wherein the baseplate is adapted to be mounted on the exterior surface of a door and the end of the pivoting retraction lever adapted to drive the vertical rod door latch extends into an interior of the door having the vertical rod door latch located therein.

19. An electric latch retraction device for driving a vertical rod door latch comprising:

a pivoting retraction lever having an end adapted to drive the vertical rod door latch;

a limit switch mounted to detect a position of the retraction lever at a pivoting limit of motion thereof and provide a limit signal indicative thereof;

a linear sensor providing a vertical position signal corresponding to a vertical position of the pivoting retraction lever;

a linear driver mounted to vertically drive the pivoting retraction lever;

a control circuit connected to drive the linear driver in vertical motion and connected to receive the limit signal and the vertical position signal, the control circuit driving the pivoting retraction lever in vertical motion and detecting installation position errors of the electric latch retraction device relative to the vertical rod door latch from the limit signal and the vertical position signal by determining whether the electric latch retraction device has been installed with the retraction lever at its pivoting limit of motion thereof, and using the vertical position signal to determine that sufficient additional travel is available for the linear driver to drive the retraction lever and correctly operate the vertical rod door latch.

20. The electric latch retraction device for driving a vertical rod door latch according to claim 19 wherein the vertical rod door latch includes a vertical rod and a plate attached to the vertical rod and wherein the end of the pivoting retraction lever adapted to drive the vertical rod door latch contacts the plate when driving the vertical rod door latch, said installation position error being identified by the control circuit detecting that the limit signal is received prior to the control circuit driving the retraction lever in vertical motion.

* * * * *